US009528744B2

(12) United States Patent
Frossati

(10) Patent No.: US 9,528,744 B2
(45) Date of Patent: Dec. 27, 2016

(54) HOLDER FOR A SAMPLE TO BE COOLED TO A LOW TEMPERATURE IN A VACUUM SPACE AND $^3$HE—$^4$HE DILUTION REFRIGERATOR ADAPTED TO ACCOMMODATE SUCH A HOLDER

(76) Inventor: Giorgio Frossati, Leiden (NL)

( * ) Notice: Subject to any disclaimer, the term of this patent is extended or adjusted under 35 U.S.C. 154(b) by 1135 days.

(21) Appl. No.: 13/001,841

(22) PCT Filed: Jun. 22, 2009

(86) PCT No.: PCT/NL2009/050369

§ 371 (c)(1),
(2), (4) Date: Feb. 4, 2011

(87) PCT Pub. No.: WO2010/002245

PCT Pub. Date: Jan. 7, 2010

(65) Prior Publication Data

US 2011/0138847 A1 Jun. 16, 2011

(30) Foreign Application Priority Data

Jul. 3, 2008 (NL) ..... 2001755

(51) Int. Cl.
*F25D 31/00* (2006.01)
*F25D 19/00* (2006.01)

(52) U.S. Cl.
CPC ..... *F25D 19/006* (2013.01)

(58) Field of Classification Search
CPC ..... F17C 3/085; F17C 13/086; F17C 2270/05; G01N 24/14; G01N 2223/3103; G01N 2035/00346; G01N 1/02; F25D 19/006
USPC ..... 62/51.1, 610; 165/276, 277
See application file for complete search history.

(56) References Cited

U.S. PATENT DOCUMENTS

| | | | | |
|---|---|---|---|---|
| 4,281,708 | A * | 8/1981 | Wing et al. | 165/277 |
| 4,707,998 | A | 11/1987 | Linner et al. | |
| 5,235,817 | A * | 8/1993 | Gallagher et al. | 62/51.1 |
| 5,829,256 | A * | 11/1998 | Rada | 62/51.1 |
| 6,758,059 | B2 * | 7/2004 | Kelly et al. | 62/610 |
| 2005/0283230 | A1 | 12/2005 | Joshi et al. | |

FOREIGN PATENT DOCUMENTS

| | | |
|---|---|---|
| DE | 10038119 | 2/2002 |
| GB | 2282437 | 4/1995 |

(Continued)

*Primary Examiner* — Frantz Jules
*Assistant Examiner* — Brian King
(74) *Attorney, Agent, or Firm* — Michael Best & Friedrich LLP

(57) ABSTRACT

Holder (1) for a sample to be cooled to a low temperature in a vacuum space, comprising a carrier body (2) for carrying the sample in thermal contact and contact means (3, 4, 5) for bringing the carrier body into thermal contact with a cooling body to be brought to the low temperature, wherein the contact means can be switched between a first mode, in which there is no thermal contact between the carrier body and the cooling body, and a second mode in which there is thermal contact between the carrier body and the cooling body, and a probe for inserting into a vacuum space in a refrigerator such a holder for a sample to be cooled to a low temperature in this vacuum space, and a refrigerator, in particular a 3He-4He dilution refrigerator, adapted to accommodate such a probe.

18 Claims, 2 Drawing Sheets

(56) References Cited

FOREIGN PATENT DOCUMENTS

Figure 1:
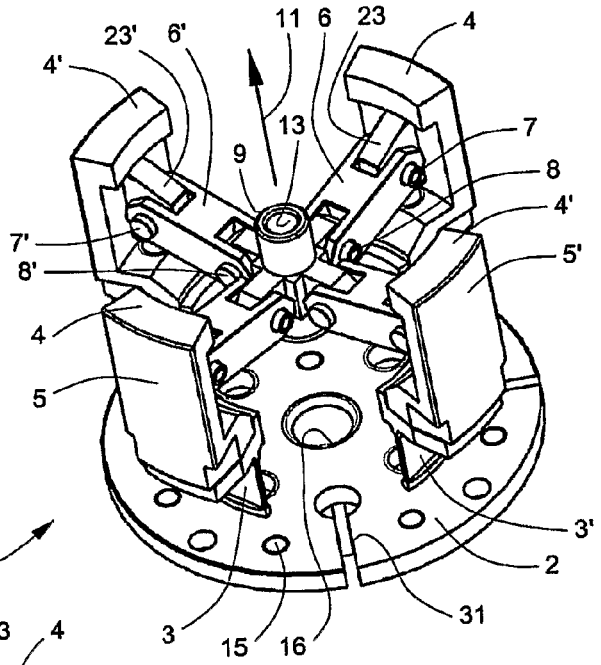

| | | | |
|---|---|---|---|
| JP | 2000-274976 | | 10/2000 |
| WO | WO 02-073100 | | 9/2002 |
| WO | WO 2006092380 | A1 * | 9/2006 |
| WO | 2007-101305 | | 9/2007 |

* cited by examiner

HOLDER FOR A SAMPLE TO BE COOLED TO A LOW TEMPERATURE IN A VACUUM SPACE AND $^3$HE—$^4$HE DILUTION REFRIGERATOR ADAPTED TO ACCOMMODATE SUCH A HOLDER

The invention relates to a holder for a sample to be cooled to a low temperature in a vacuum space, comprising a carrier body for carrying the sample in thermal contact and contact means for bringing the carrier body into thermal contact with a cooling body to be brought to a low temperature, in particular a holder for a sample in a $^3$He-$^4$He dilution refrigerator to be cooled to temperatures in the millikelvin range.

The mixing chamber of a $^3$He-$^4$He dilution refrigerator is situated in a vacuum space. A sample to be cooled in this refrigerator is screwed to the mixing chamber in known manner or thermally anchored on a cold finger. Thermal contact between sample and mixing chamber can only be brought about by mechanical contact between the sample or, if it is situated in a housing, the sample housing and the metal of the mixing chamber or cold finger. This contact is brought about in known manner at room temperature, when the dilution refrigerator is at atmospheric pressure.

At very low temperatures it is difficult to realize a good heat transport between sample and cold source because of the thermal resistance which is inversely proportional to the microscopic contact surface between sample and cold source, and so to the pressure on the surface between sample or sample housing and cold source. If a piece of metal is for instance to be cooled, and some power, in the order of the cooling capacity of the dilution refrigerator (several microwatts), is here to be dissipated on the metal itself, the metal must then be screwed firmly to the mixing chamber.

It is perceived to be a drawback of cooling with a dilution refrigerator that the changing of a sample is particularly time-consuming, and expensive due to the costs of liquid helium. The introduction of the cryo-free dilution refrigerators, which do not use liquid helium but a Pulsed Tube Cryo-cooler (PTC), has made the cooling time even longer due to the limited cooling capacity of the available PTCs. In order to obviate this drawback use is increasingly being made of dilution refrigerators with a tube which connects the mixing chamber to the outside and in which a sample can be introduced in a so-called clear-shot and cooled without the dilution refrigerator having to be heated. The sample is then attached to a probe, which is mounted in a vacuum tube and is then pushed slowly up to the mixing chamber during the clear-shot. The sample and sample housing can then be brought into mechanical and thermal contact with the mixing chamber. The enthalpy of the sample is many times greater at room temperature than at millikelvins, and the heat must thus be removed as the probe is pushed inward in order to prevent the dilution refrigerator being heated too much. It is of essential importance that the components of the probe which connect the sample on the warm side of the probe carry a negligible amount of heat to the sample, since it can otherwise not be cooled to sufficiently low temperature.

It is an object of the invention to provide a holder which enables simple and rapid insertion of a sample into and removal thereof from a vacuum space in a cryogenic device, for instance in a $^3$He-$^4$He dilution refrigerator, wherein the desired temperature of the vacuum space can be maintained during the insertion or removal.

When a sample is inserted the amount of generated heat which is generated as a result of the insertion must be minimal.

These objects are achieved, and other advantages gained, with a holder of the type stated in the preamble, the contact means of which can be switched according to the invention between a first mode in which there is no thermal contact between the carrier body and the cooling body, and a second mode in which there is thermal contact between the carrier body and the cooling body.

Such a holder makes it possible to fix a sample to the carrier body in thermal contact outside a refrigerator, to insert the holder into the vacuum space, wherein the contact means are switched to the first mode, and then, once the holder has been inserted into the vacuum space, to create a vacuum in the vacuum space and switch the contact means to the second mode.

In an embodiment of a holder according to the invention switching means are provided for switching the contact means between the first and the second mode.

In an advantageous embodiment the contact means comprise a spring element manufactured from a heat-conducting, elastically deformable material, and a contact body carried by this spring element.

In a preferred embodiment of a holder according to the invention, wherein the cooling body is provided by the walls of the vacuum space, the contact means comprise at least one pair of contact bodies which are provided with respective contact surfaces co-acting with at least a part of a wall of the vacuum space, which contact surfaces can be brought into contact simultaneously with the respective wall parts.

In such a holder the contact bodies are for instance mutually coupled by respective coupling arms, which are each coupled at an outer end to a contact body for pivoting about a first pivot shaft and coupled at another outer end to a coupling body for pivoting about a second pivot shaft, wherein the respective first and second pivot shafts are mutually parallel and the coupling body is displaceable in a direction transversely of the pivot shafts between a first position, in which the contact means are in the first mode, and a second position in which the contact means are in the second mode.

A displacement of the coupling body in said direction results in a pivoting movement of the coupling arms and a simultaneous displacement of the contact bodies in an inward or outward radial direction relative to the coupling body. Because the outward displacement is in radial direction, the thermal contact between the contact surfaces and the wall of the vacuum space is realized substantially without friction, so that substantially no energy (for discharge) is dissipated when the thermal contact is established.

In a practically advantageous embodiment the coupling body can be coupled to a switching rod extending outside the vacuum space.

The contact means preferably comprise two pairs of contact bodies which are mutually coupled by respective coupling arms, wherein the coupling bodies of a first pair of contact bodies extend transversely relative to the coupling bodies of a second pair of contact bodies.

The advantages of a holder provided with such a coupling body are particularly manifest in an embodiment in which this holder can be coupled to a second holder in a manner such that the coupling body of this holder can be coupled to the coupling body of the second holder, and the respective coupling bodies of this holder and of the second holder are simultaneously displaceable between a first position, in which the contact means of the first and the second holder are in the first mode, and a second position in which the contact means of the first and the second holder are in the second mode.

With such coupled holders it is possible to hold a sample at the desired, lowest temperature in a first, preferably lower holder and to hold the second holder, which is coupled in thermally insulated manner to the first holder, at a temperature between the lowest temperature and room temperature, whereby a heat buffer is thus realized between the sample at the lowest temperature and room temperature.

For the purpose of coupling this holder to a second holder, this holder is provided in an embodiment with coupling means, which coupling means for instance comprise at least one bar of a thermally insulating material.

It is noted that the holder according to the invention is suitable for application in cryo-free machines of different types, although particularly in per se known liquid $^4$He-cooled cryostats, in combination with a $^3$He-$^4$He cryo-free machine, because of the limited length of this type of refrigerator, which implies a limited length of the probe.

The invention also relates to a probe for inserting into a vacuum space in a refrigerator an above described holder according to the invention for a sample to be cooled to a low temperature in this vacuum space.

The invention further relates to a refrigerator, in particular a $^3$He-$^4$He dilution refrigerator, adapted to accommodate an above described probe according to the invention.

The invention will be elucidated hereinbelow on the basis of exemplary embodiments, with reference to the drawings.

In the drawings

Figure 2:
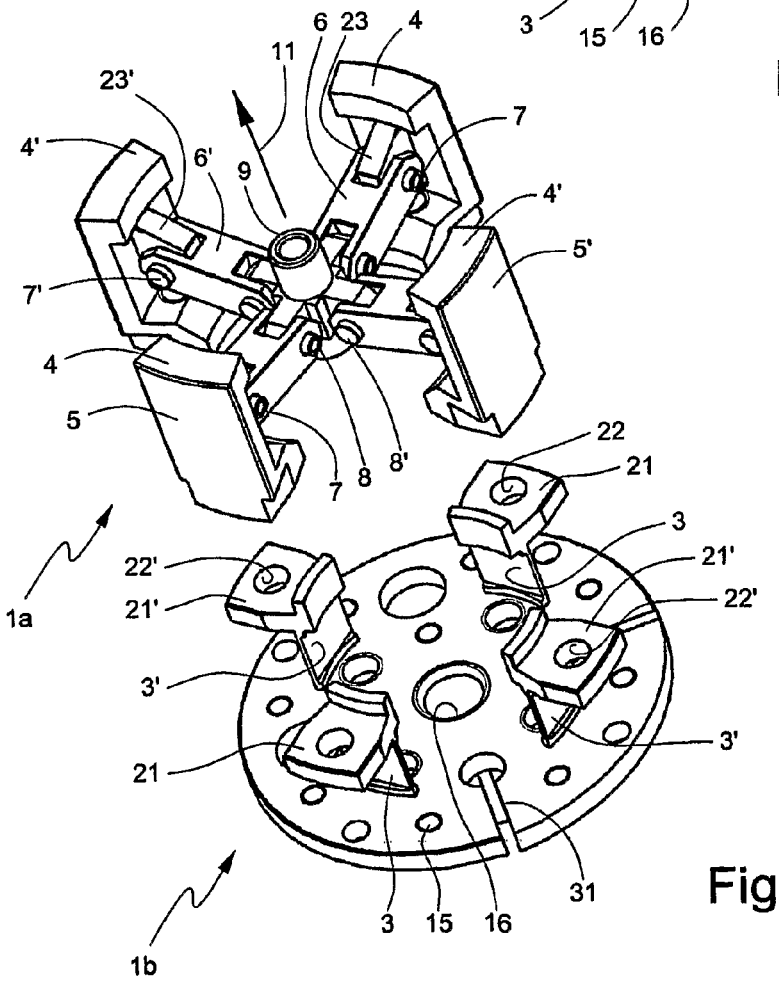
Figure 3:
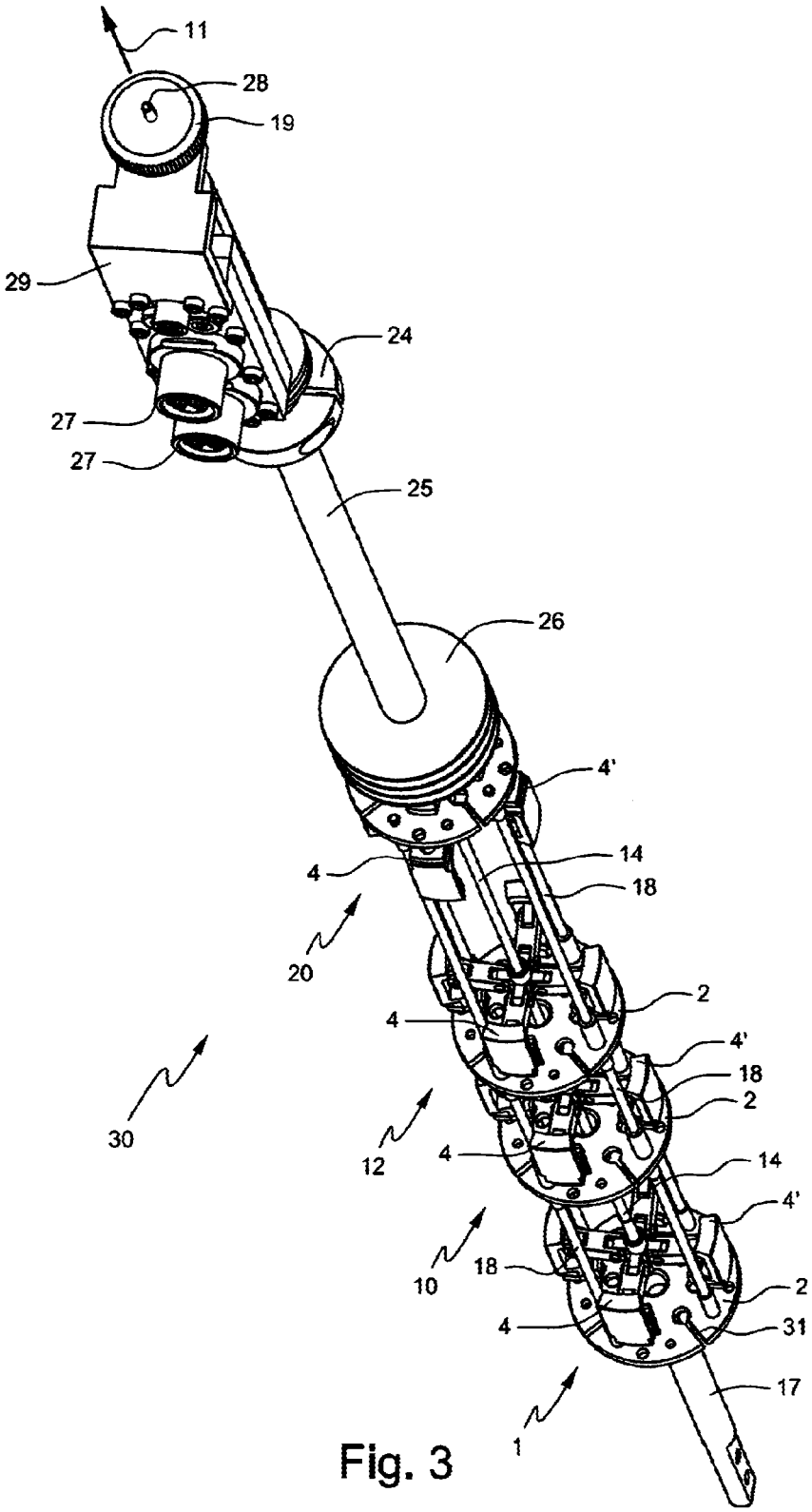

FIG. 1 shows a perspective top view of an embodiment of a holder according to the invention, and FIG. 2 is an exploded view of the holder shown in FIG. 1, and FIG. 3 shows a perspective top view of a probe with four coupled holders according to the invention.

Corresponding components are designated in the figures with the same reference numerals.

FIG. 1 shows a holder 1 for inserting a sample into a cylindrical vacuum space (not shown), with a carrier body 2, four contact elements 3, 4, 5; 3', 4', 5', each consisting of a spring element 3, 3' and a contact body 4, 4' with a contact surface 5, 5' to be directed toward the wall of the vacuum space. Contact surfaces 5, 5' have a form which corresponds to the part of the wall of the vacuum space with which these contact surfaces 5, 5' are simultaneously brought into contact. Contact bodies 4, 4' are mutually coupled by respective coupling arms 6, 6', which are each coupled at an outer end to a contact body 4, 4' for pivoting about a first pivot shaft 7, 7' and coupled at another outer end to a central coupling body 9 for pivoting around a second pivot shaft 8, 8'. The respective first pivot shafts 7, 7' and second pivot shafts 8, 8' are parallel in each coupling arm 6, 6', and coupling body 9 is displaceable in the direction transversely of pivot shafts 7, 8; 7', 8' (indicated by arrow 11) between a first position, in which contact surfaces 5, 5' are clear of the wall of the vacuum space, and a second position in which the contact surfaces are pressed against the wall of the vacuum space, and are thus in thermal contact with the relevant part of this wall. For this purpose coupling arms 6, 6' have a length such that in unloaded situation of springs 3, 3' the opposite coupling arms 6, 6' enclose an obtuse angle which can be increased by displacing central coupling body 9, as a result of which contact bodies 4, 4' are displaced in outward direction. In the shown example coupling bodies 4, 4' form two pairs which are mutually coupled by respective coupling arms 6, 6', wherein coupling arms 6 of the one pair of contact bodies 4 extend transversely relative to coupling arms 6' of the other pair of contact bodies 4'. Present in central coupling body 9 is a drill hole 13 provided with an internal screw thread into which a switching rod 14 (shown in FIG. 3) can be screwed. This switching rod 14 is manufactured from a thermally insulating material, for instance an epoxy bar reinforced with carbon fibre, and its end remote from holder 1 protrudes outside the refrigerator, where the switching rod is provided with a screw thread and an adjusting nut for the purpose of adjusting the height of the rod relative to the refrigerator, and thereby adjusting the position of contact bodies 4, 4' relative to the wall of the vacuum space. The figure also shows drill holes 15 in which thermometers, samples, heating elements and coupling rods 18 (shown in FIG. 3) can for instance be mounted, slots 31 for through-feed of cables, capillaries, optic fibres and the like, and a central drill hole 16 for passage of a switching rod 14 to a subsequent holder or for mounting a sample or cold finger 17 at that position. Heat from carrier body 2 is discharged via spring elements 3, 3' to contact bodies 4, 4' and through contact surfaces 5, 5' to the respective thermal bath. Stainless steel support elements 23, 23' are soldered to contact bodies 4, 4' with silver in order to prevent coupling arms 6, 6' deforming the copper as a result of the great forces which can be exerted during displacement of coupling body 9 in axial direction 11.

It has been found that, with the holder shown in the figure, at a temperature of 4 K, 800 mK, 100 mK and 13 mK a cooling capacity of respectively about 500 mW, 20 mW, 100 μW and 1 μW can be realized in a cryo-free dilution refrigerator.

It is noted that the displacement of a holder in a vacuum space has a stepwise progression. During a first step the holder will for instance be admitted so far into the vacuum space that the contact bodies can be brought into contact with a part of the wall of the space that has been brought to the temperature of liquid nitrogen (77 K) (or to 50 K in a cryo-free dilution refrigerator), after which the holder is admitted further to a level at which the contact bodies can be brought into contact with a part of the wall that has been brought to the temperature of liquid helium (4.2 K) (or to 2.6-4.6 K in a cryo-free dilution refrigerator), after which the holder is finally admitted further to a level at which the contact bodies can be brought into contact with a part of the wall that is in thermal contact with the mixing chamber of the 3He-4He dilution refrigerator.

FIG. 2 shows an exploded view of holder 1 shown in FIG. 1, with parts 1*a* and 1*b*. Carrier body 2 in lower part 1*b* is manufactured from pure copper, and is provided with four strips 3, 3', on the upper end of which is mounted a plate 21, 21' with a hole 22, 22'. The respective plates 21, 21' are screwed fixedly into corresponding threaded holes (not shown) in the respective contact bodies 4, 4'. Strips 3, 3' can also be formed integrally with contact bodies 4, 4'. The form and the thickness of strips 3, 3' are partially determined by the desired heat conduction. The thickness of strips 3, 3' can for instance be variable. In order to prevent the formation of poorly conductive copper oxide, holder 1 is gold-plated after assembly of the two parts 1*a*, 1*b*.

FIG. 3 shows a probe 29 with four holders 1, 10, 12, 20, which are mutually coupled by means of coupling rods 18 of a thermally insulating material, and the respective contact bodies 4, 4' of which can be brought into thermal contact with parts of the wall of a vacuum space at four different height positions. Coupling the holders 1, 10, 12, 20 in this way makes it possible to keep a sample in bottom holder 1 at the desired, lowest temperature, and to keep the second, third and fourth holders 10, 12 and 20, which are mutually coupled in thermally insulated manner, at an (increasingly higher) temperature between the lowest temperature and room temperature. Wiring and possible thermometers can be thermally anchored to respective carrier plates 2, whereby a heat buffer is thus realized between the sample at the lowest temperature and room temperature, and the heat leak to the sample is thus minimized. A cold finger 17 for attaching a sample thereto is screwed onto the underside of carrier plate 2 of lowest holder 1. The figure also shows an adjusting screw 19 on a screw thread on outer end 28 of switching rod 14, with which this switching rod can be moved in axial direction 11, a thin-walled stainless steel vacuum tube 25 for throughfeed of measuring cables, for instance cables for thermometers and the like, which are connected to connecting plugs 27 on a connecting head 29, and copper radiation shields 26 soldered to the vacuum tube. Vacuum tube 25 extends through and is displaceable in a vacuum O-ring seal in a flange 24 which is at room temperature.

The invention claimed is:

1. A device for holding a sample to be cooled by a cooling body, the device comprising:

a carrier body; and a contact assembly carried by the carrier body, the contact assembly being operably switched between a first mode, in which there is no thermal contact between the contact assembly and the cooling body, and a second mode in which there is thermal contact between the contact assembly and the cooling body;

wherein the sample is cooled to a temperature in the millikelvin range, and the cooling body includes one or more walls of a vacuum space, and the contact assembly includes at least one pair of contact bodies having respective contact surfaces that are simultaneously brought into thermal contact with at least a portion of a respective wall of the vacuum space when the contact assembly is placed into the first mode, wherein each of the contact bodies is coupled to a respective coupling arm for pivoting movement relative to the coupling arm about a respective first pivot shaft, each coupling arm pivotally coupled to a coupling body for pivoting movement relative to the coupling body about a respective second pivot shaft, each respective first pivot shaft and second pivot shaft being parallel to one another, wherein the coupling body is displaceable relative to the carrier body in a direction transverse to the pivot shafts between a first position, in which the contact assemblies are in the first mode, and a second position in which the contact assemblies are in the second mode.

2. The device as claimed in claim 1, further comprising:

a switching device coupled to said contact assembly for switching the contact body between the first mode and the second mode.

3. The device as claimed in claim 1, wherein the contact assembly includes a spring element made of a heat-conducting, elastically deformable material, and a contact body carried by this spring element.

4. The device as claimed in claim 1, wherein the coupling body is coupled to a switching rod extending outside the vacuum space.

5. The device as claimed in claim 1, wherein the contact assembly includes two pairs of contact bodies which are mutually coupled by respective coupling arms and the respective coupling arms of a first pair of contact bodies extend transversely relative to the respective coupling arms of a second pair of contact bodies.

6. The device as claimed in claim 1, wherein said device is a first device, said first device being coupled to a second device structurally the same as the first device, the respective coupling body of said first device being coupled to the respective coupling body of the second device, and the respective coupling bodies of said first and second devices being simultaneously displaceable between a first position, in which the contact assemblies of the first and the second devices are in the first mode, and a second position in which the contact assemblies of the first and the second devices are in the second mode.

7. The device as claimed in claim 1, wherein said device is a first device further comprising coupling means for coupling said first device to a second device structurally the same as said first device, and the contact assembly of said first device includes two pairs of contact bodies mutually coupled by respective coupling arms extending transversely relative to respective coupling arms of a second pair of contact bodies.

8. The first device as claimed in claim 7, wherein the coupling means includes at least one bar of a thermally insulating material.

9. The device as claimed in claim 1, wherein each first pivot shaft is adjacent an end of a respective coupling arm and each second pivot shaft is adjacent an opposing end of the respective coupling arm.

10. An apparatus for cooling one or more samples, the apparatus comprising:

at least one holding device for holding a respective sample to be cooled to a temperature in the millikelvin range, each holding device including a carrier body having one or more mounting bodies coupled thereto and a contact assembly coupled to the one or more mounting bodies; and a cooling device having a vacuum tube with one or more walls, wherein the walls of the vacuum tube are cooled, and wherein the contact assembly of each holding device includes at least two contact bodies, each contact body coupled to a shared coupling body by a respective coupling arm and including an outer side, each contact body being controlled to be in thermal contact with at least one of the vacuum tube walls when it is desired to cool the respective sample and controlled to not be in thermal contact with the at least one vacuum tube wall otherwise, the shared coupling body being displaceable relative to the carrier body in a direction parallel to the outer sides of the contact bodies.

11. The apparatus as claimed in claim 10, wherein each contact assembly includes, first and second pairs of contact bodies, the outer side of each contact body being in thermal contact with a respective wall of said vacuum tube and an inner side, and each outer side of said contact bodies is simultaneously brought into contact with the wall of said vacuum tube when the coupling body is moved in the direction parallel to the outer sides of said contact bodies.

12. The apparatus as claimed in claim 11, further comprising at least two holding devices for holding at least two respective samples, and a control device coupled to the coupling bodies of each contact assembly, said control device being accessible from an area outside the vacuum tube and operated to move said coupling bodies in a direction parallel to the outer sides of said contact bodies.

13. The apparatus as claimed in claim 10 wherein said cooling device comprises a $^3$He-$^4$He dilution refrigerator.

14. The apparatus as claimed in claim 11, wherein said coupling arms are pivotally coupled to the inner side of the respective contact bodies at respective first shafts and pivotally coupled to the coupling body at respective second shafts, the respective first and second shafts of said first pair of contact bodies being parallel and the respective first and second shafts of said second pair of contact bodies being parallel.

15. The apparatus as claimed in claim 14, wherein the respective first and second shafts of said first pair of contact bodies are perpendicular to the respective first and second shafts of said second pair of contact bodies.

16. A method for cooling a sample in a cooling device, the method comprising:

inserting a holding device for holding the sample into a vacuum tube of the cooling device, wherein contact surfaces of the holding device are not in thermal contact with walls of the vacuum tube;

after inserting the holding device, moving a switching device in a direction parallel to a longitudinal axis of the walls of the vacuum tube to move the contact surfaces of the holding device into thermal contact with the walls of the vacuum tube; and cooling the sample to a temperature in the millikelvin range.

17. A holder for inserting a sample into a cylindrical vacuum space defining a longitudinal axis, the holder comprising:

a carrier body;

a central coupling body displaceable relative to the carrier body in a direction parallel to the longitudinal axis;

four contact elements, each contact element coupled to the central coupling body, each contact element including a spring element and a contact body with a contact surface to be directed toward the wall of the vacuum space, the contact surfaces having a form that corresponds to the part of the wall of the vacuum space with which the contact surfaces are simultaneously brought into contact to cool the sample to a temperature in the millikelvin range.

18. The holder as claimed in claim 17, wherein the contact bodies are mutually coupled by respective coupling arms, which are each coupled at an outer end to a contact body for pivoting about a first pivot shaft and coupled at another end to the central coupling body for pivoting around a second pivot shaft, the respective first pivot shafts and second pivot shafts being parallel in each coupling arm, and the coupling body being displaceable in the direction transversely of pivot shafts between a first position, in which contact surfaces are clear of the wall of the vacuum space, and a second position in which the contact surfaces are pressed against the wall of the vacuum space, and are thus in thermal contact with the relevant part of the wall of the vacuum space.

* * * * *